US006279161B1

(12) United States Patent
Johnston

(10) Patent No.: US 6,279,161 B1
(45) Date of Patent: Aug. 28, 2001

(54) BIOGRAPHICS: APPAREL THAT HAS MOVING GRAPHICS AND PATTERNS

(76) Inventor: Steven E. Johnston, 7700 Hidden Ivy Ct., Orlando, FL (US) 32819

( * ) Notice: Subject to any disclaimer, the term of this patent is extended or adjusted under 35 U.S.C. 154(b) by 0 days.

(21) Appl. No.: 09/487,698

(22) Filed: Jan. 19, 2000

(51) Int. Cl.[7] ..... A41B 1/00
(52) U.S. Cl. ..... 2/69; 2/79; 2/115; 2/275
(58) Field of Search ..... 2/69, 79, 22, 239, 2/275, 115

(56) References Cited

U.S. PATENT DOCUMENTS

| | | | | |
|---|---|---|---|---|
| 890,792 | * | 6/1908 | Peine | 2/275 |
| 1,817,053 | | 11/1931 | Zerk . | |
| 2,000,898 | | 5/1935 | Donaldson | 2/226 |
| 2,554,361 | | 5/1951 | Ettien et al. | 2/93 |
| 3,771,169 | | 11/1973 | Edmund | 2/2.1 R |
| 3,801,987 | | 4/1974 | Thompson, Jr. | 2/125 |
| 4,282,609 | | 8/1981 | Freedman et al. | 2/239 |
| 4,282,728 | | 8/1981 | Tapp et al. | 66/182 |
| 4,625,336 | | 12/1986 | Derderian | 2/79 |
| 5,033,127 | | 7/1991 | Schmeltz | 2/269 |
| 5,040,245 | | 8/1991 | Staley | 2/409 |
| 5,109,546 | * | 5/1992 | Dicker | 2/69 |
| 5,282,277 | * | 2/1994 | Onozawa | 2/69 |
| 5,367,708 | | 11/1994 | Fuhimoto | 2/22 |
| 5,608,913 | | 3/1997 | LaCoste | 2/115 |
| 5,737,772 | * | 4/1998 | Dicker et al. | 2/69 |

FOREIGN PATENT DOCUMENTS

| | | | |
|---|---|---|---|
| 1007746 | | 2/1952 | (FR) . |
| 2557436 | * | 5/1985 | (FR) . |
| 375712 | | 10/1939 | (IT) . |

* cited by examiner

*Primary Examiner*—Rodney Lindsey
(74) *Attorney, Agent, or Firm*—Brian S. Steinberger; Law Offices of Brian S. Steinberger

(57) ABSTRACT

Garments and apparel that animate subsurface muscles, joints and tendons. The garments can include athletic wear such as leggings that conform to both the thigh and calf of a user and arm coverings that conform over the arm, and even over the torso of the body. Other applications can include dancewear, theatrical costuming, medical and therapeutic products. The garment can include seams about slits, each slit being parallel to one another running down the exterior sides of the leggings and arm coverings. Sewn to the edges of the slits, beneath the slits can be a sublayer elastic material having a different color and/or texture than the surface color and/or texture of the garment. Alternatively, instead of seams, the material can be formed from a chemically or another technically produced fabric that has designated stretch and non-stretch areas engineered at selected locations.

19 Claims, 4 Drawing Sheets

BIOGRAPHICS: APPAREL THAT HAS MOVING GRAPHICS AND PATTERNS

This invention relates to clothing apparel, and in particular to a garments with hidden sublayer materials under seams strategically located over body muscles, tendons, and joints, where the sublayer(s) only become visible and vary in size when the muscles, tendons, and joints are flexed, bent or moved, causing an animation effect of the muscles, tendons and joints.

BACKGROUND AND PRIOR ART

Full body type garments with stretchable type seams have been used that allow users to wear body hugging clothes during activities such as athletics, exercising, and the like. See for example, U.S. Pat. Nos. 2,554,361 to Ettien et al and 3,771,169 to Edmund. However, these types of garments are generally limited to vertical seams usually placed adjacent and under armpit areas, along and down the inside of leg areas and the like, that are intended to remain primarily out of sight.

U.S. Pat. Nos. 3,801,987 to Thompson, Jr. and 5,608,913 to Lacoste each provide ventilation and stretchable type seams beneath the armpit areas. These patents generally are intended to continuously hide their seams and only use the seams to allow the garments to stretch over the body during physical activities.

U.S. Pat. No. 5,040,245 to Staley describes an undergarment having vertically oriented and always externally visible stretchable panels in the thigh area that allow the user a conforming fit.

U.S. Pat. Nos. 1,817,053 to Zerk and 4,282,609 to Freedman et al. each describe stretchable hosiery having varying colored portions that are primarily used for forming a slimming appearance when being worn, with the dark (colored) portions always being visible.

Italian patent 375,712 and French patent 1,007,746 to Thierfelder show additional hosiery having stretchable panels that are always visible when being worn.

U.S. Pat. No. 5,367,708 to Fujimoto describes wearing articles using various stretchable panels that generally extend over "muscle fibers", abstract. However, the panels are always externally visible, and the wearing articles are for "achieving a taping function", abstract.

U.S. Pat. No. 2,000,989 to Donaldson describes a lower body garment formed from plural and always visible stretchable materials each attached to another material at different orientations allowing the garment to stretch while the wearer is bending and stretching.

U.S. Pat. No. 5,033,127 to Schmeltz describes transformable clothing that can be adjustably lengthened as needed.

None of the patents cited above allow for hidden sublayers beneath seams strategically located over selected body muscles, tendons and joints that only become visible when the muscles, tendons and joints are flexed, bent, and moved.

SUMMARY OF THE INVENTION

The first objective of the present invention is to provide a garment having a hidden sublayer material beneath a seam that is strategically located over a muscle that becomes visible to vary in dimension and size when the muscle is flexed.

The second object of this invention is to provide a garment having a hidden sublayer material beneath a seam that is strategically located over a joint that becomes visible to vary in dimension and size when the joint is being bent.

The third object of this invention is to provide a garment having a hidden sublayer material beneath a seam that is strategically located over a tendon that only becomes visible to vary in dimension and size when the tendon is moved.

The fourth object of this invention is to provide a garment having a surface portion that appears to animate an underlying muscle being flexed.

The fifth object of this invention is to provide a garment having a surface portion that appears to animate an underlying joint being bent.

The sixth object of this invention is to provide a garment having a surface portion that appears to animate an underlying tendon being moved.

A preferred embodiment of the invention includes methods and apparel for causing animation effects of muscles, tendons and joints with body garments. The invention includes garments having strategically located seams positioned over various muscles, tendons and/or body joints. Each closely oriented seam is connected to the other by being sewn to an underlying elastic material having a different color than that of the garment's exterior surface. Alternatively, each of the seams can be formed from chemically or other technically produced fabric that has a designated stretch and non-stretch areas engineered for selected locations. When the muscle, tendon and/or joint is flexed and bent the underlying material appears in varying dimensions mimicking that of the muscle, tendon and joint so as to cause an animation effect when viewed from another person looking at the garment. The body muscles can include side thigh muscles, calf muscles, arm muscles, and the like, and combinations, thereof. The body joint can include the knee, kneecap, elbow, shoulder, wrist, hip, ankle, and the like. The novel seams can be positioned in various arrangements such as angled slits parallel to one another running down along the sides of the wearer's thigh and calf areas.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1A:
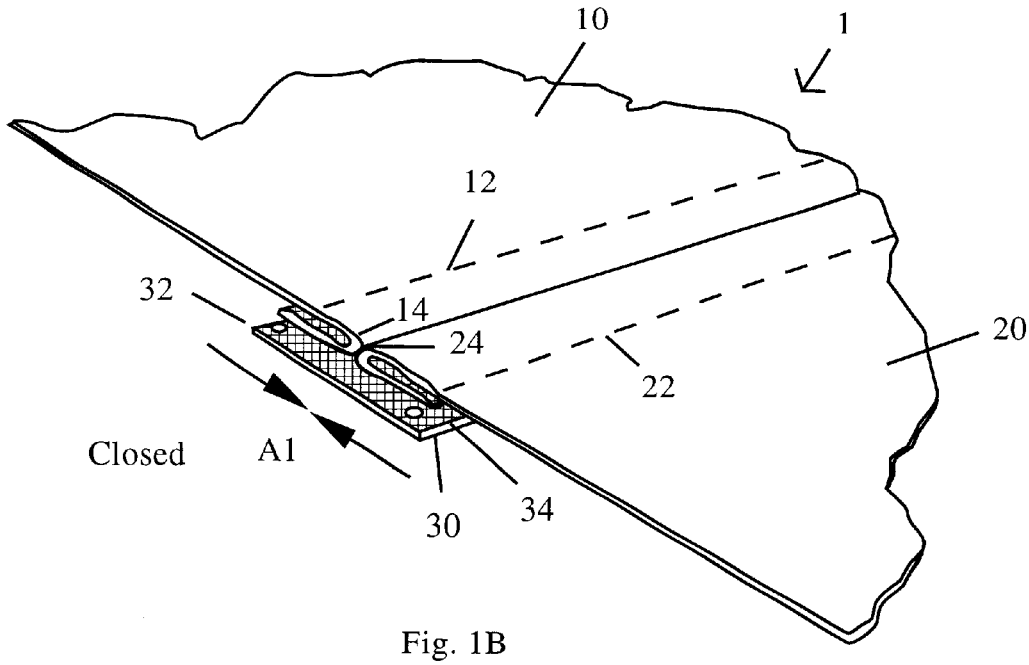
FIG. 1A is a perspective view of a closed position of the novel seam used in the invention.
Figure 1B:
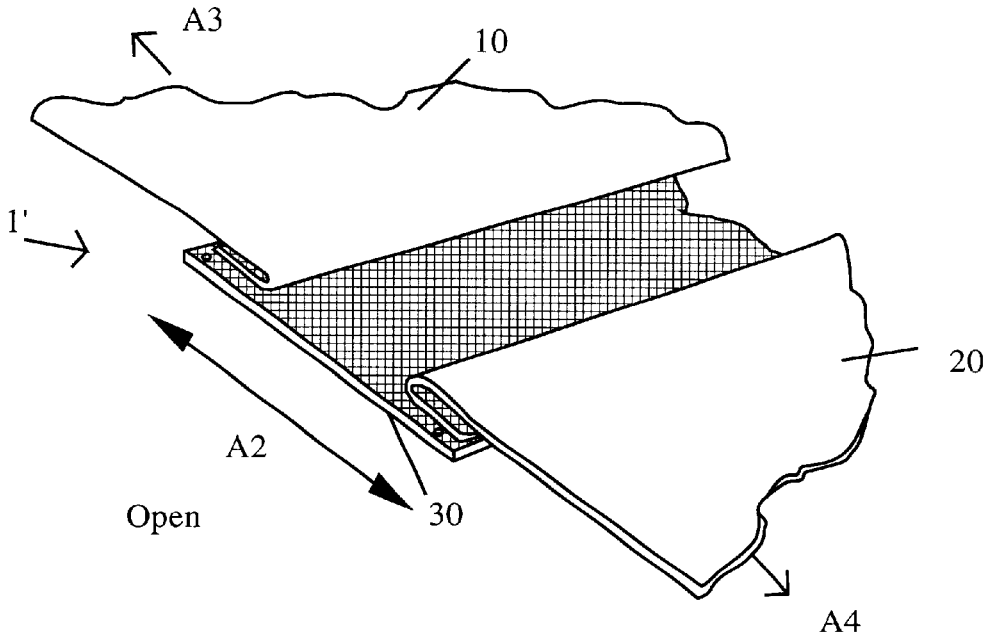
FIG. 1B is a perspective view of an open position of the novel seam of FIG. 1A.

FIG. 1A is a perspective view of a closed position I of the novel seam and underlying material used in the invention. FIG. 1B is a perspective view of an open position 1" of the novel seam and underlying layer of FIG. 1A. Referring to FIGS. 1A–1B, the garment 1 includes two sections of the same non-stretch materials 10 and 20 formed from fabrics such as nylon, micro fiber blends, non-stretch cotton/polyester blends, non-stretch silks and rayon's, and other non-stretch fabrics. Referring to FIGS. 1A–1B, sections 10 and 20 are positioned adjacent to one another by flap edges 14, 24 each sewn by stitch lines 12, 14 to sides 32, 34, respectively by an elastic underlying material 30. Instead of sewn constructions, the material can be chemically or another type of technically produced fabric that has a designated stretch and non-stretch areas engineered at selected locations. Underlying material 30 can be an elastic stretchable material such as but not limited to materials such as Lycra®, Spandex, power net, mesh, polypropylene, tricot, other stretch fabrics, and the like.

The underlying material 30 can have a different color than that of the color of the surfaces on exterior garment sections 10 and 20. For example, underlying material 30 can be colored blue while surface garment sections 10 and 20 are white. Alternatively, underlying material 30 can have sparkles while the surface garments 10, 20 are not. Still alternatively, underlying material 30 can be a glow in the dark material.

The invention utilizes the contrasting qualities of two textile materials joined together, one being highly elastic, and the other non-elastic. These different materials are positioned in such a way as to work in conjunction with the movement of the body's muscles, tendons, and joints from rest through various stages of motion. By strategically joining areas of elastic and nonelastic material the finished garments have counteracting patterns so that the appearing and disappearing underlying material layers create the effect of animation when viewed.

Referring to FIG. 1A, the normal biased state of elastic material 30 causes seam sides 14 and 24 garment sections 10, 20 to come together in the direction of arrow Al. Referring to FIG. 1B, when either garment section 10 and/or garment section 20 is pulled in the direction of arrows A3 and A4, respectively, underlying material 30 stretches to various dimensions 30' and opens in the direction of arrow A3 exposing the surface of material 30.

FIGS. 2A–2G show a preferred embodiment application of using the novel underlying elastic materials and scams on legging wear for a person going from standing straight to running and stopping.

Figures 2A, 2B, 2C, 2D, 2E, 2F, 2G:
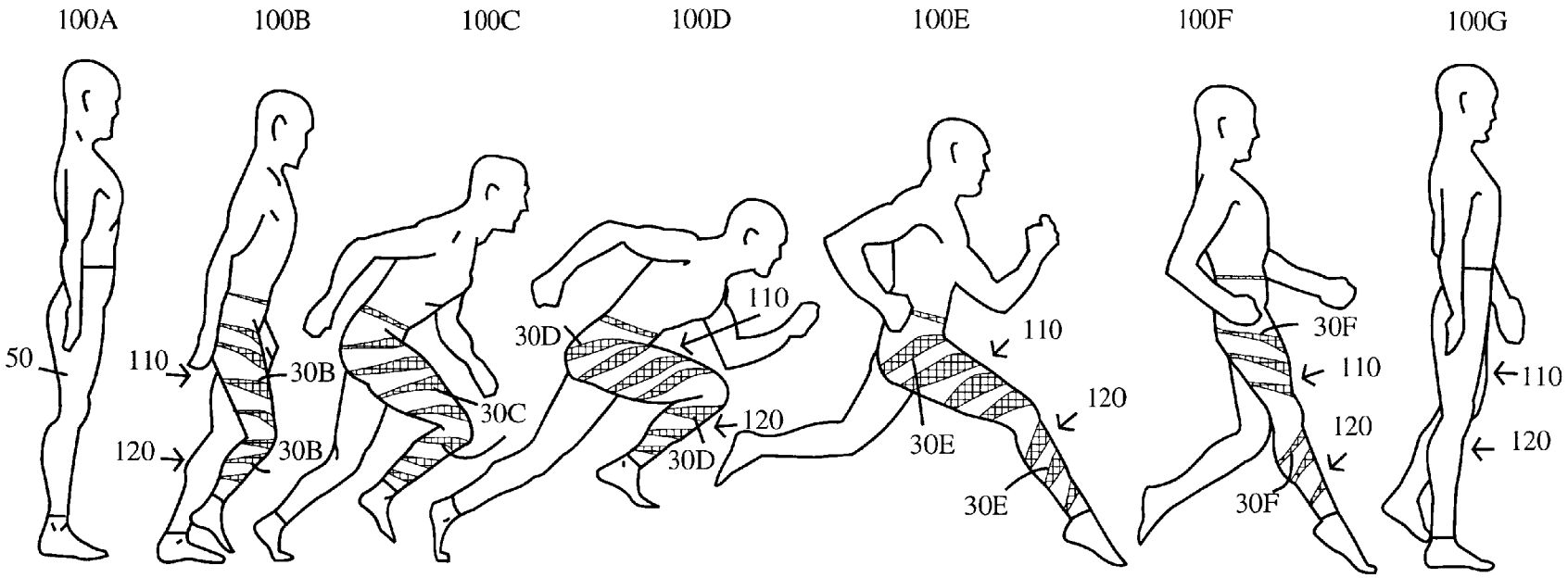
FIG. 2A is a side view of a person wearing a garment with the novel seam of FIGS. 1A–1B in an initial rest non-moving position.
FIG. 2B is a side view of the person of FIG. 2A starting a run.
FIG. 2C is a side view of the person of FIG. 2A taking off on a run.
FIG. 2D is a side view of the person of FIG. 2A in a run position.
FIG. 2E is a side view of the person of FIG. 2A in a long stride position.
FIG. 2F is a side view of the person of FIG. 2A slowing down.
FIG. 2G is a side view of the person of FIG. 2A in a stop position.

FIG. 2A is a side view 1000A of a person wearing a garment with the novel seam of FIGS. 1A–1B in an initial rest non-moving position. Garment 50 can be a nonstretch material such as but not limited to nylon, cotton, cotton/polyester blends, silks, rayon's, micro fibers, and other non-stretch fabrics, which are tightly fit to cover the lower portions of the person's body such as the thigh and calf areas.

FIG. 2B is a side view 100B of the person of FIG. 2A starting a run. The novel seam and underlying elastic material of FIGS. 1A–1B, are arranged in a first set of parallel angled horizontal slits 110 selectively positioned over side thigh muscles of the person, and a set of parallel angled horizontal slits 120 selectively positioned over side calf muscles of the person. Each of the slits 110, 120 are individual versions of those described in reference to FIG. 1A–1B. The slight upward bending of the leg and garment 50 begins to expose the underlying material 30B to slight varying degrees.

FIG. 2C is a side view 100C of the person of FIG. 2A taking off on a run. The leg portion 50 is now more bent and the underlying material 30C is more exposed toward the front right side of the leg 50 than to the rear left side of the leg 50.

FIG. 2D is a side view 100D of the person of FIG. 2A in a run position. Note that upper leg thigh covering slits 110 expose more underlying material 30D toward the left rear of the leg 50 than lower leg calf covering slits 120 which expose more underlying material 30D toward the front right of the leg.

FIG. 2E is a side view 100E of the person of FIG. 2A in a long stride position. In this position each of the upper slits 110 expose the most uniform amounts of underlying material 30E, which appears larger than the uniform showing of underlying material 30E of lower calf portion 120.

FIG. 2F is a side view 100F of the person of FIG. 2A slowing down with thigh underlying material and calf underlying material 30F showing similar amounts of material to that of FIG. 2B.

FIG. 2G is a side view 100G of the person of FIG. 2A in a stop position where the slits 110 and 120 are closed and no underlying material is visible.

Figures 3A, 3B, 3C, 3D, 3E, 3F:
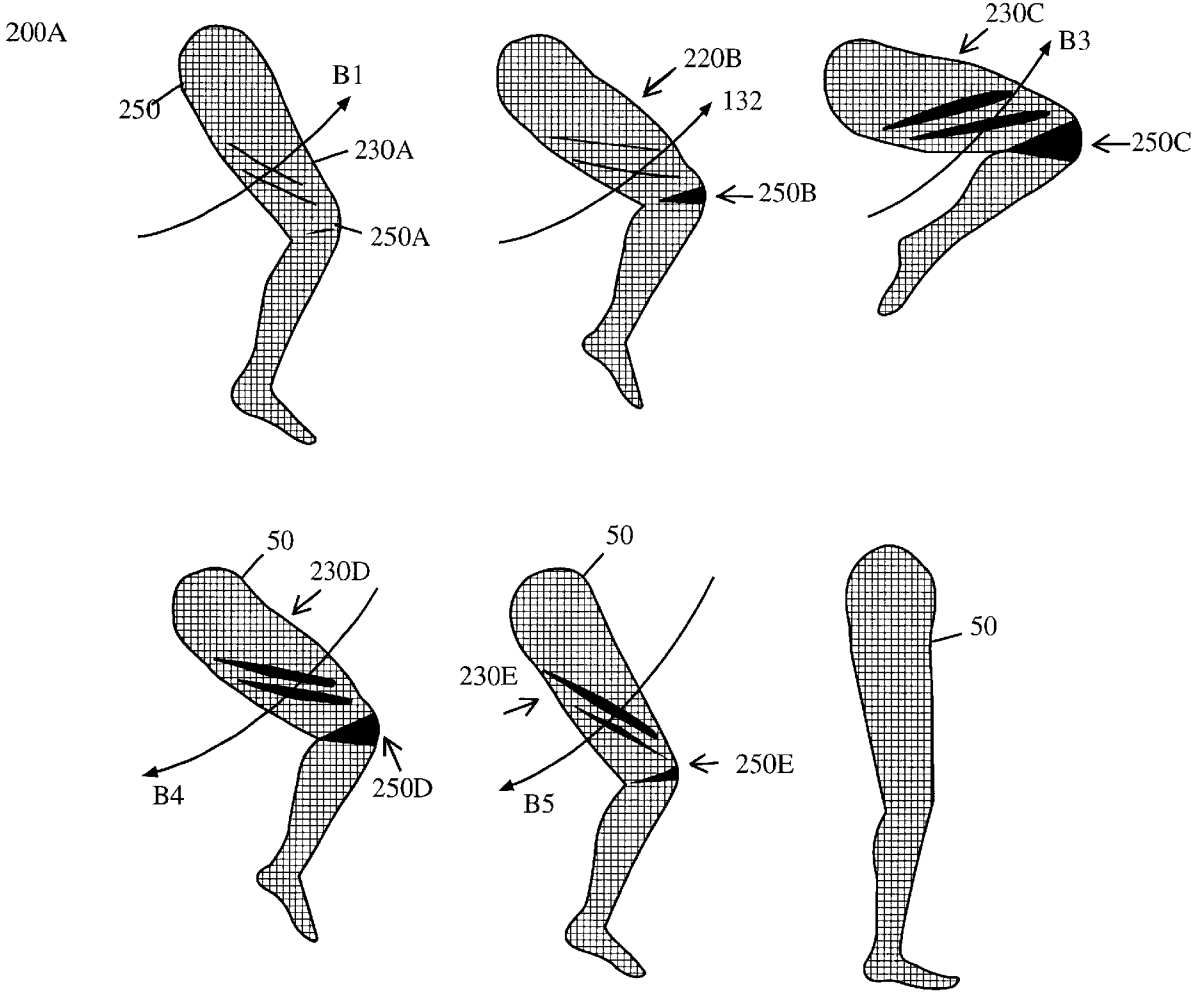
FIG. 3A is a side view of a leg wearing the garment invention with the knee portion beginning to raised upward in the direction of arrow B1.
FIG. 3B is a side view of FIG. 3A with the knee continuing to be raised upward.
FIG. 3C is a side view of FIG. 3B with the knee portion fully raised upward.
FIG. 3D is a side view of FIG. 3C with the leg beginning to be lowered and straightened out in the direction of arrow B4.
FIG. 3E is a side view of FIG. 3D with the leg continuing to be lowered and straightened out.
FIG. 3F is a side view of FIG. 3E with the leg fully straightened out.

FIG. 3A is a side view of a leg wearing the garment invention with the knee portion beginning to raised upward in the direction of arrow B1, showing thigh underlying materials 230A, and a knee cap underlying material 250A positioned over a kneecap joint, wherein the materials 230A and 250A are animating the underlying thigh muscles and knee cap joint.

FIG. 3B is a side view of FIG. 3A with the knee continuing to be raised upward in the direction of arrow B2 so that more underlying material of the thigh region 230B and kneecap region 250B become visible. FIG. 3C is a side view of FIG. 3B with the knee portion fully raised upward in the direction of arrow B3 where the largest areas of thigh underlying material 230C and kneecap material 250C are now exposed.

FIG. 3D is a side view of FIG. 3C with the leg beginning to be lowered and straightened out in the direction of arrow B4, wherein underlying material 230D and 250D is approximately similar in dimensions to that of FIG. 3B. FIG. 3E is a side view of FIG. 3D with the leg continuing to be lowered and straightened out in the direction of arrow B5 with underlying material 230E and 250E having less exposure than the preceding Figure FIG. 3F is a side view of FIG. 3E with the leg fully straightened out where no underlying material is visible.

Figure 4A:
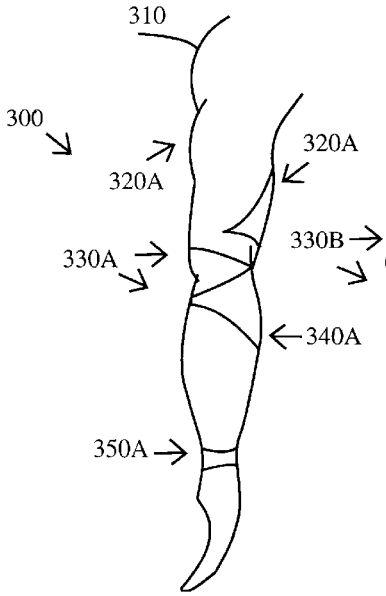
FIG. 4A is a side view of an arm wearing the garment invention with the upper arm, elbow, andforearm in a downward straight position.
Figure 4B:
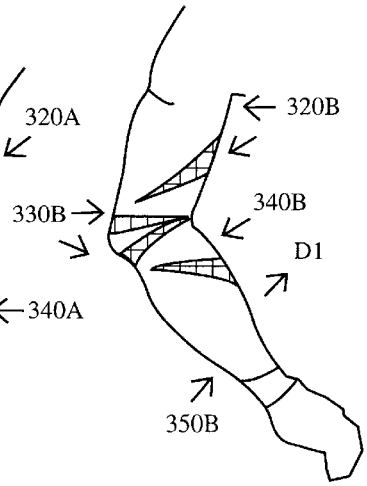
FIG. 4B is a side view of FIG. 4A with the forearm beginning to bend upward in the direction of arrow D1.
Figure 4C:
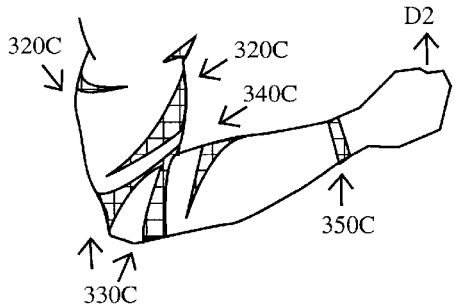
FIG. 4C is a side view of FIG. 4B with the forearm fully raised upward and the hand raised upward in the direction of arrow D2.
Figure 4D:
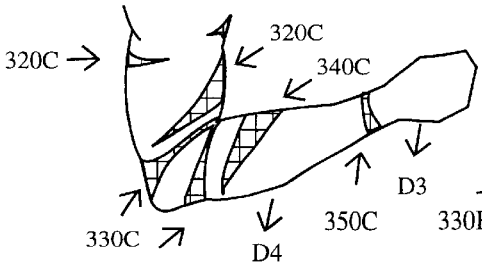
FIG. 4D is a side view of FIG. 4C with the hand moving downward in the direction of arrow D3 and the forearm moving downward in the direction of arrow D4.
Figure 4E:
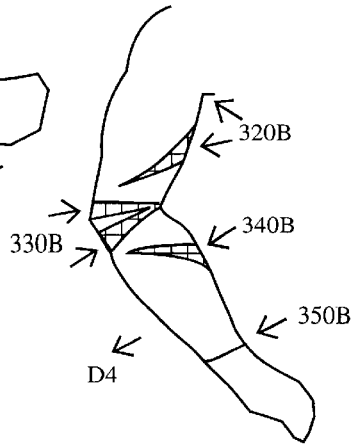
FIG. 4E is a side view of FIG. 4D with the forearm continuing to be lowered and straightened out.

FIG. 4A is a side view of an arm 300 wearing the garment invention arm covering 310 with the upper arm, elbow, and forearm in a downward straight position. Underlying material for covering the upper biceps muscle 320A, elbow joints 330A, forearm muscle 340A and wrist joint 350A are shown substantially hidden. FIG. 4B is a side view of FIG. 4A with the forearm beginning to bend upward in the direction of arrow D1, where underlying material 320B, 330B, 340B, and 350B beginning to be exposed. FIG. 4C is a side view of FIG. 4B with the forearm fully raised upward and the hand raised upward in the direction of arrow D2, where underlying material 320C, 330C, 340C, 340C and 350C fully exposed. FIG. 4D is a side view of FIG. 4C with the hand moving downward in the direction of arrow D3 and the forearm moving downward in the direction of arrow D4, and having underlying material exposed similar to that shown in FIG. 4C. FIG. 4E is a side view of FIG. 4D with the forearm continuing to be lowered and straightened out, where the underlying material is exposed similar to that shown in FIG. 4B.

Figure 4F:
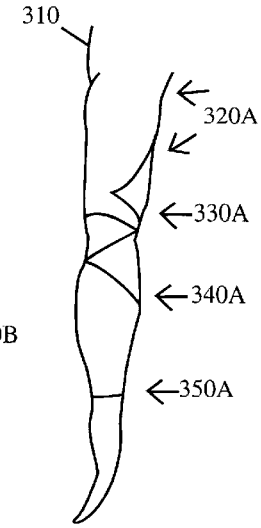
FIG. 4F is a side view of FIG. 4E with the arm fully straightened out.

FIG. 4F is a side view of FIG. 4E with the arm fully straightened out which is similar to that of FIG. 4A.

The invention can include the novel seams and slits in legging coverings, arm coverings and torso coverings, either separately or in different combinations.

Although the preferred embodiments describe having the sublayer being a different color than the surface materials, the sublayer can also be of a different texture material than the surface materials. Alternatively, the sublayer material can be of both a different color and a different texture than the surface material color and texture.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A method of causing animation effects of muscles, tendons and joints with body garments, comprising the steps of:

forming a slit having a variable appearing sublayer portion in a garment, the sublayer portion being a different color than a surrounding surface portion on both sides of the slit, the slit positioned over a body part that is chosen from at least one of a body muscle, joint and tendon moving the body part; and simultaneously opening and closing the slit, wherein the variable appearing sublayer portion animates the body part being moved.

2. The method of causing animation effects of claim 1, wherein the body muscle includes:

a side thigh muscle.

3. The method of causing animation effects of claim 1, wherein the body muscle includes:

a side calf muscle.

4. The method of causing animation effects of claim 1, wherein the body joint includes at least one of:

a kneecap and an elbow.

5. The method of causing animation effects of claim 1, wherein the body muscle includes:

a side thigh muscle and a side calf muscle.

6. The method of causing animation effects of claim 1, wherein the body muscle includes at least one of:

a forearm muscle and a biceps muscle.

7. The method of causing animation effects of claim 1, wherein the body part includes:

a forearm muscle, an elbow and a biceps muscle.

8. The method of causing animation effects of claim 1, wherein the sublayer portion includes:

elastic material having side portions joined to the garment by being sewn to a dual seam.

9. The method of causing animation effects of claim 1, wherein the sublayer includes:

angled sublayer portions substantially parallel to one another, each arranged within slits along an exterior side of the garment.

10. The method of causing animation effects of claim 1, wherein the body muscle includes:

arm muscles and leg muscles.

11. Biographic apparel for animating body joints, muscles and tendons, comprising in combination:

a garment for being fit over a body portion;

a non vertical slit on the garment positioned over at least one of a muscle, a joint, and a tendon; and a sublayer having a different color than the garment positioned underneath the slit that only becomes visible in varying dimensions while the body portion is being moved causing an animation of the at least one of the muscle and the joint, on the surface of the garment.

12. The biographic apparel of claim 1, wherein the garment includes:

a legging covering.

13. The biographic apparel of claim 12, wherein the slit includes:

parallel angled slits along the legging covering.

14. The biographic apparel of claim 11, wherein the sublayer includes:

an elastic material.

15. The biographic apparel of claim 11, wherein the slit includes:

a seam connected to each side of the sublayer.

16. The biographic apparel of claim 11, wherein the garment includes:

an arm covering.

17. The biographic apparel of claim 11, wherein the slit include:

parallel angled slits along the arm covering.

18. The biographic apparel of claim 11, wherein the garment includes:

parallel angled slits along a legging covering; and parallel angled slits along an arm covering.

19. Biographic apparel for animating body joints, muscles and tendons, comprising in combination:

a garment adapted to be fit over a body portion;

a slit on the garment for being positioned over at least one of a muscle, a joint, and a tendon; and a sublayer having a different color than the garment positioned underneath the slit that only becomes visible in varying dimensions while the body portion is being moved causing an animation of the at least one of the muscle and the joint, on the surface of the garment.

* * * * *